US007926616B2

(12) United States Patent
Groy

(10) Patent No.: US 7,926,616 B2
(45) Date of Patent: Apr. 19, 2011

(54) LADDER CADDY

(76) Inventor: Abram D. Groy, Purcellville, VA (US)

( * ) Notice: Subject to any disclaimer, the term of this patent is extended or adjusted under 35 U.S.C. 154(b) by 48 days.

(21) Appl. No.: 12/614,061

(22) Filed: Nov. 6, 2009

(65) Prior Publication Data

US 2010/0050414 A1 Mar. 4, 2010

Related U.S. Application Data

(62) Division of application No. 11/456,360, filed on Jul. 10, 2006, now abandoned.

(60) Provisional application No. 60/698,380, filed on Jul. 12, 2005.

(51) Int. Cl.
*E06C 7/14* (2006.01)

(52) U.S. Cl. ..... 182/129; 248/210

(58) Field of Classification Search ..... 182/129; 248/210

See application file for complete search history.

(56) References Cited

U.S. PATENT DOCUMENTS 881,054 A * 3/1908 Carle, Jr. ..... 248/210
3,792,750 A * 2/1974 Madison ..... 182/206
4,653,608 A * 3/1987 Casada ..... 182/121
4,862,994 A * 9/1989 Hughes, Sr. ..... 182/122
5,279,389 A * 1/1994 Crockett ..... 182/129

* cited by examiner

*Primary Examiner* — Alvin C Chin-Shue
(74) *Attorney, Agent, or Firm* — Charles S. McGuire; George R. McGuire; Bond Schoeneck & King, PLLC

(57) ABSTRACT

A device for attachment to a conventional type of ladder for holding tools and other diverse items in a position for convenient access by a workman on the ladder is described in two embodiments. In both embodiments the device includes a rigid, linearly elongated member carrying a pair of projections having free ends in opposing, spaced relation, the distance between the free ends being selectively adjustable by relative movement of the projections along an axis parallel to a spaced from the axis of the elongated member. In a first described embodiment, the elongated member is formed by a pair of tubular, telescopingly engaged members with one of the projections fixedly mounted to opposite ones of the pair of members. In the preferred embodiment, the elongated member is a one-piece rod with one of the projections fixedly connected thereto and the other projection mounted to a bracket which is slidable along the rod. The projections are positioned with the free ends spaced by a distance greater than the width of the ladder and the device is held with the projections outwardly adjacent openings in the ladder side rails at opposite ends of a selected one of the hollow rungs where the device is to be mounted. The projections are then relatively moved to decrease the distance between the free ends to cause the latter to extend through the openings in the side rails and into opposite ends of the selected rung, thereby releasably mounting the device to the ladder. The diverse items may then be supported by hooks mounted to the elongated member.

1 Claim, 2 Drawing Sheets

LADDER CADDY

REFERENCE TO RELATED APPLICATION

The present application is a divisional of U.S. application Ser. No. 11/456,360, filed Jul. 10, 2006, which claims priority to and incorporates the subject matter of Provisional Application No. 60/698,380, filed Jul. 12, 2005.

BACKGROUND OF THE INVENTION

The present invention relates to a device for releasable attachment to a conventional ladder to provide a means of supporting other items used by a person on the ladder. More specifically, the invention is embodied in a device including at least one elongated member and a pair of brackets or projections relatively movable for releasable engagement with and disengagement from the ladder.

When supported on a ladder, particularly the type with the lower end resting on a horizontal or other suitable surface and the upper end against a wall, roof edge or other stationary support, a workman must often carry items associated with the job being done. For example, while on the ladder, a workman may need to have readily at hand a can of paint and other painting utensils, a calking gun, a can of roof cement and/or other supplies or tools. Rather than mounting and dismounting the ladder each time a different material or tool is required, it is more expeditious to have several items available at the same time at the user's position on the ladder. This can be not only inconvenient but also dangerous as the workman's hands are occupied with tools and supplies rather than holding securely to the ladder.

It is a principal object of the present invention to provide a device for convenient and safe support of items for use by a workman mounted on a ladder.

Another object is to provide an article which may be quickly and easily connected to and detached from a conventional, rung-type ladder, and which is uniquely suited to support tools, supplies, and the like for convenient access by a workman on the ladder.

Other objects will in part be obvious and will in part appear hereinafter.

SUMMARY OF THE INVENTION

In accordance with the foregoing objects, the invention comprises one or more linearly elongated members with a pair of finger-like projections or brackets mounted thereon. The projections have free ends, pointing toward one another along a linear axis spaced from and parallel to the axis of the elongated member(s). The distance between the free ends of the projections is selectively adjustable to permit movement of the projections to a position wherein the free ends of the projections are spaced by a distance greater that the width of the ladder at the position where the device is to be mounted, and then to move the free ends of the projections to a position wherein the free ends of the projections extend into openings in the ladder side rails at opposite ends of one of the ladder rungs, thus firmly supporting the device on the ladder. The elongated member(s) carries a plurality of hooks or hangers for support of the tools, materials, supplies, etc. for use by a person on the ladder. The device is dismounted from the ladder by relative manual movement of the projections back to a position wherein the distance between the free ends is greater than the width of the ladder, i.e., to a position wherein the free ends of the projections no longer extend into the openings at opposite ends of the ladder rung.

In a first disclosed embodiment, a pair of hollow, tubular members are telescopingly engaged for relative axial movement along a common, linear axis. A spring or other elastic element within the hollow members is attached to each so that they are biased toward a position wherein the overall length of the two members is at its shortest dimension. By grasping one of the members in each hand, they may be moved axially, against the biasing force, to increase the overall length. First and second projections are fixedly connected to the respective tubular members with free end portions of the projections pointing toward one another. The tubular members are extended until the distance between the free ends of the projections exceeds the width of the conventional ladder upon which, and at the position whereon, the device is to be mounted. The free ends of the projections are then positioned outwardly adjacent the side rails of the ladder, in alignment with a pair of the holes which are conventionally formed in the side rails where the rungs are connected. The spring bias then moves the telescoping members toward a shorter overall length with the free ends of the projections engaged in the holes in the ladder side rails at opposite ends of the rung where the device is mounted. The device is then securely affixed to the ladder and tools, supplies, etc. may be supported on open hooks which are mounted upon each of the telescoping members.

In a second disclosed embodiment, which is considered the preferred embodiment, rather than a pair of telescoping members, a single rod or bar, elongated along a linear axis, is provided. As in the first disclosed embodiment, a pair of projections having free ends pointing toward one another along a linear axis spaced from and parallel to the axis of the elongated rod is provided. One of the projections is fixedly attached to the rod and the other includes a lever which is spring biased to engage one of a series of notches along one side of the rod, thereby releasably fixing the position of the projection relative to the rod and to the fixedly attached projection. An end portion of the lever may be manually moved, against the spring bias, to release the engagement of the lever with the notch on the rod and permit movement of the projection along the rod. The device may the be mounted upon the ladder as before, with the free ends of the projections extending into the holes in the ladder side rails at opposite ends of on of the rungs, and dismounted by again manually moving the lever to disengage the notch and moving the projection away from the fixed projection.

The invention also resides in the combination of a supporting device of the type described with a conventional type of ladder, and in the method of mounting the support device to the ladder.

The foregoing and other features of construction and operation of the device will be more readily understood from the following detailed disclosure, taken in conjunction with the accompanying drawing.

DETAILED DESCRIPTION

Figure 1:
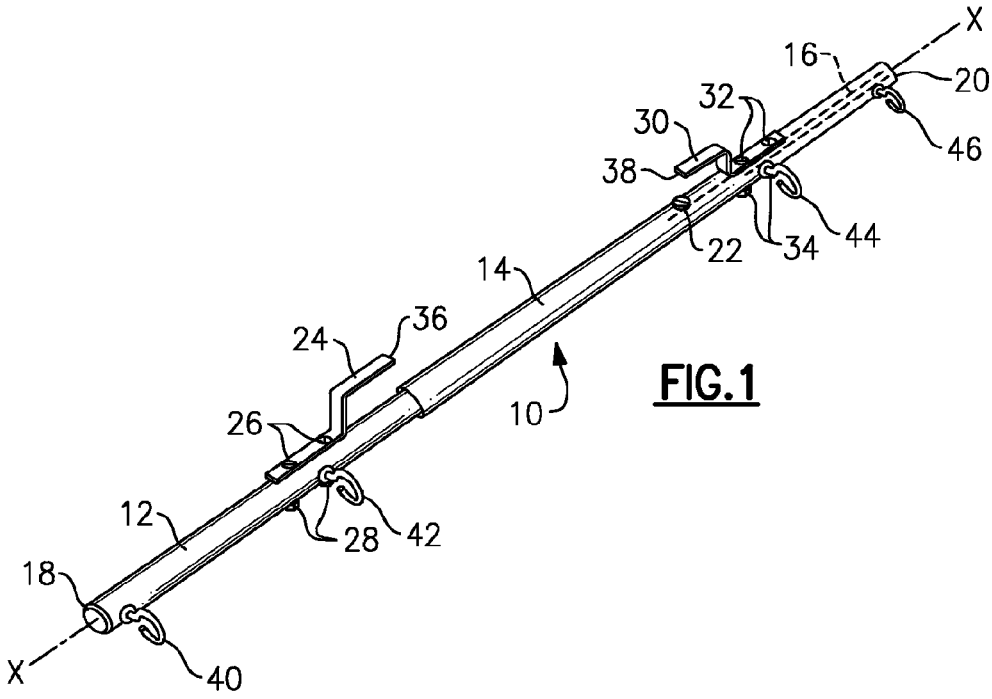
FIG. 1 is a perspective view of the device, shown in a first embodiment.
Figure 2:
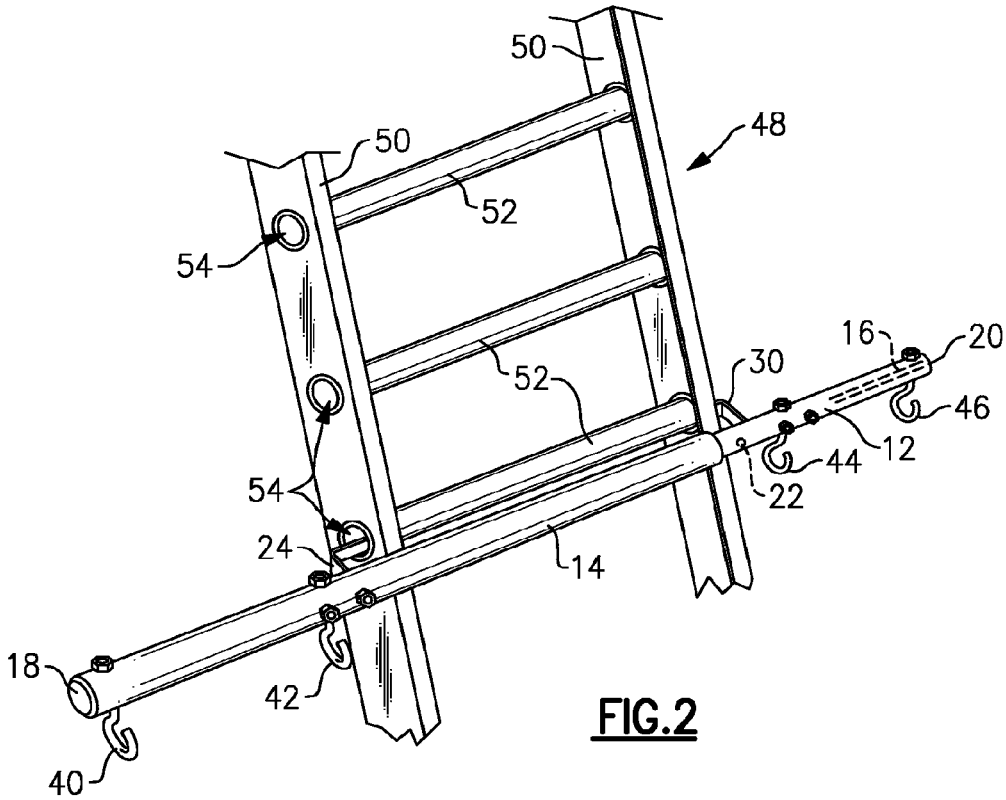
FIG. 2 is a perspective view of the embodiment of FIG. 1 illustrating the manner of attachment of the device to a conventional ladder.

Referring now to the drawings, the device of the invention is shown in a first embodiment in FIGS. 1 and 2 denoted generally by reference numeral 10. Device 10 includes hollow, tubular members 12 and 14 mounted for reciprocal, telescoping movement with respect to one another along a common axis X-X. Biasing means such as a coil spring, or the illustrated elastic cord 16, is mounted within the tubular members and connected to one end of each to urge the members toward relative movement in the direction which shortened the overall length of the device, i.e., in the direction which minimizes the distance between outer ends 18 and 20 of members 12 and 14, respectively. The limit of such movement is defined by contact of the inner end of member 12 contacting screw 22 which extends through member 14. Projection 24 is fixedly attached to the outer surface of member 12 by flat-head bolts 26, secured by nuts 28. Likewise, projection 30 is affixed to member 14 by bolts and nuts 32 and 34, respectively. Projections 24 and 30 have free, terminal ends 36 and 38, respectively, which point toward one another. Open hooks 40 and 42 are fixedly attached to member 12, and open hooks 44 and 46 are affixed to member 14.

In FIG. 2 device 10 is shown in the intended relation to conventional ladder 48 comprising side rails 50 and rungs 52. Holes 54 in side rails 50 are aligned with opposite ends of hollow rungs 52, as the latter are affixed to the side rails. In order to mount device 10 upon ladder 48, one of members 12 and 14 is grasped in each hand and the two members are pulled apart, i.e., in a direction increasing the overall length of device 10, against the biasing force of elastic cord 16. The movement continues until free ends 36 and 38 of projections 24 and 30, respectively, are spaced by a distance grater than the width of ladder 48, The device is positioned with free ends 36 and 38 of the projections in alignment with the holes at opposite ends of one of rungs 52 and the biasing force of cord 16 is allowed to move members 12 and 14 in a direction lessening the overall length of the device, thereby moving the ends of the projections into opposite ends of the hollow rung and engaging device 10 with ladder 48. When so mounted, various tools, supplies and other items may be suspended from or otherwise engaged with hooks 40, 42, 44 and 46. Device 10 may be removed from mounting to the ladder by reversing the steps described above.

Figure 3:
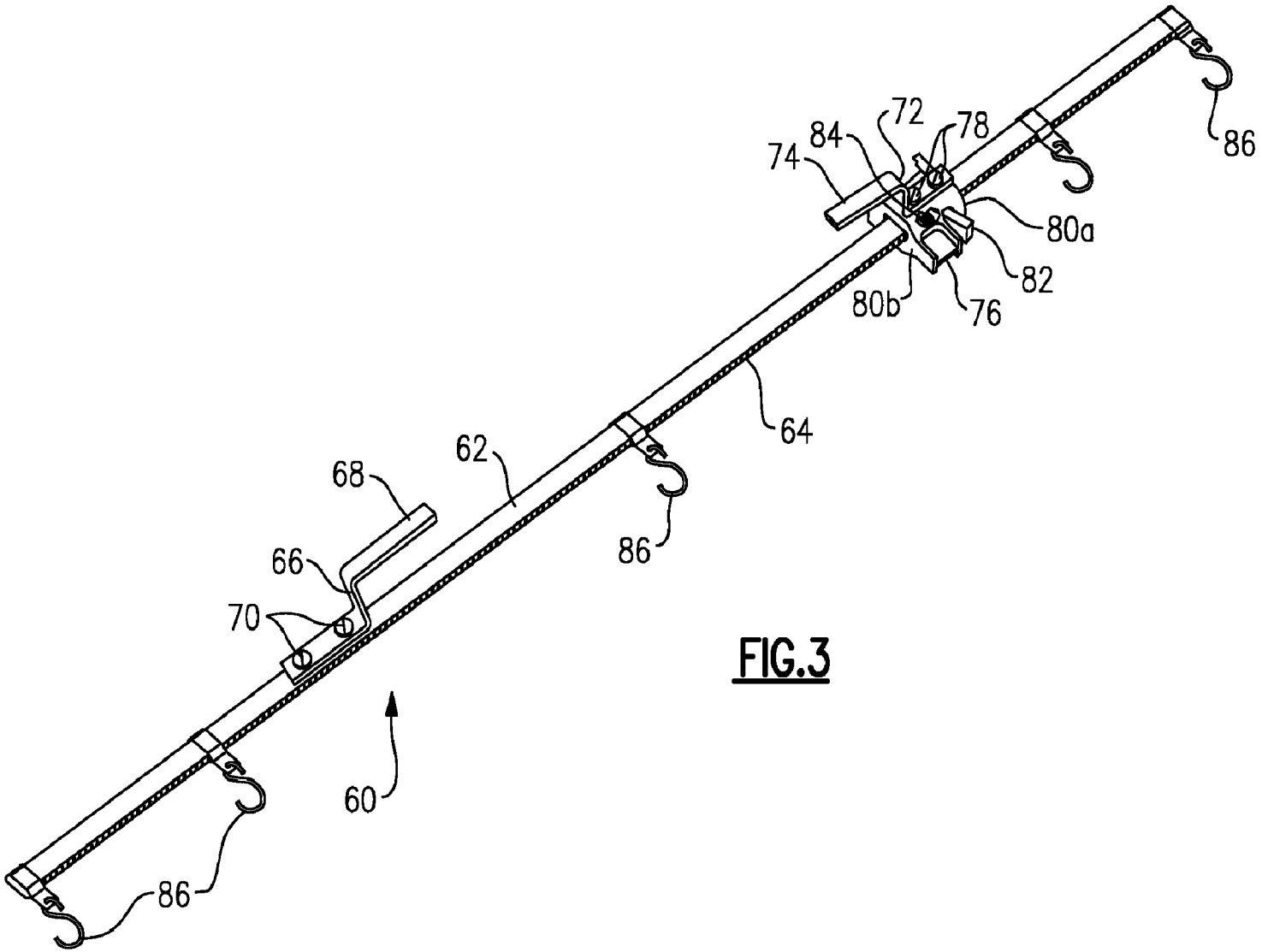
FIG. 3 is a perspective view of the preferred embodiment of the device.

Turning now to FIG. 3, the invention is shown in a preferred embodiment, denoted by generally reference numeral 60. Device 60 includes an elongated, flattened rod 62 having a succession of closely spaced notches 64, the purpose of which will be described later herein, along one edge. Projection 66, having free end portion 68, is fixedly attached to rod 62 by bolts 70 and corresponding nuts. Projection 72, having free end portion 74, is fixedly mounted to bracket 76 by screws 78, extending through openings in projection 72 and into threaded openings in bracket 76. Rod 62 extends loosely through openings in wall portions 80*a* and 80*b* of bracket 76, permitting sliding movement of the bracket (and projection 72) along rod 62. Lever 82 has an opening through which rod 62 loosely extends, the opening being large enough that lever 82 may be pivoted a limited amount in a clockwise direction (as seen from the illustrated side) about axis Y-Y. Lever 82 is biased by spring 84 toward rotation in the opposite direction, which maintains the lower edge of the opening in the lever in engagement with one of notches 64 of rod 62. Thus, in its normal position, lever 82 engages rod 62 to maintain bracket 76 (and projection 72) in fixed relation to rod 62. In order to permit movement of bracket 76 along rod 62, the lower portion of wall 80*a* and lower end of lever 82 are grasped between thumb and index finger and squeezed to rotate lever 82 sufficiently to remove it from engagement with notches 64. When bracket 76 has been moved to place projection 72 into an opening in a side rail of the ladder, releasing the pressure on lever 82 permits spring 84 to rotate lever 82 to engage the lower edge of the opening in the lever into engagement with one of notches 64. With the device mounted on the ladder, various tools, supplies, etc. may be supported upon any or all of hooks 86, mounted in fixed or slidable relation to rod 62.

It should be noted that bracket 76, including spring 72 and lever 82, is a conventional, commercially available item manufactured by Adjustable Clamp Co. of Chicago, Ill., denoted by part #3703; rod 62, in the illustrated form, including notches 64, is made by the same company and identified by part # 3730.

What is claimed is:

1. The method of supporting a plurality of diverse items in a desired position relative to a conventional ladder having a pair of side rails and a plurality of hollow rungs connected at opposite ends to said side rails with an opening in said side rails communicating with an interior of the adjacent rung, said method comprising:

a) mounting to a rigid, linearly elongated member a pair of projections, each having a free end, with said free ends in spaced, opposed relation and at least one of said projections movable with respect to the other of said projections to change the distance between said free ends, and further mounting to said elongated member a plurality of hooks adapted to support said diverse items;

b) moving said at least one of said projections to a position wherein the distance between said free ends is greater than the width of said ladder at a selected one of said rungs;

c) manually positioning said elongated member in substantially parallel, spaced relation to said selected one of said rungs with said free ends of said projections positioned outwardly adjacent said openings at opposite ends of said selected one of said rungs; and d) moving said at least one of said projections to decrease the distance between said free ends to a dimension less than said width of said ladder with said free ends extending into said openings and into the hollow interior of said selected one of said rungs, said rigid, linearly elongated member is a one-piece rod, wherein the other of said projections is affixed directly to said rod and said at least one of said projections is affixed to a bracket which is slidingly mounted to said rod, said rod includes notches along the rod, the bracket having wall portions with openings and a spring biased lever with an enlarged aperture, wherein the rod slidingly extends through said openings and aperture with the lever engaging a selected notch to maintain the bracket and said at least one of said projections in fixed relation to the rod, further including manually disengaging said spring biased lever of said bracket in order to move said bracket and thus said at least one of said projections relative to said elongated member.

* * * * *